US007607472B2

(12) United States Patent
Blomgren

(10) Patent No.: US 7,607,472 B2
(45) Date of Patent: Oct. 27, 2009

(54) HEAT TRANSFER PLATE, PLATE PACK AND PLATE HEAT EXCHANGER

(75) Inventor: Ralf Blomgren, Skanör (SE)

(73) Assignee: Alfa Laval Corporate AB (SE)

( * ) Notice: Subject to any disclaimer, the term of this patent is extended or adjusted under 35 U.S.C. 154(b) by 0 days.

(21) Appl. No.: 10/481,197

(22) PCT Filed: Jun. 4, 2002

(86) PCT No.: PCT/SE02/01063

§ 371 (c)(1),
(2), (4) Date: Dec. 17, 2003

(87) PCT Pub. No.: WO03/010482

PCT Pub. Date: Feb. 6, 2003

(65) Prior Publication Data

US 2004/0226703 A1 Nov. 18, 2004

(30) Foreign Application Priority Data

Jul. 9, 2001 (SE) ..... 0102450

(51) Int. Cl.
*F28F 3/08* (2006.01)

(52) U.S. Cl. ..... 165/167

(58) Field of Classification Search ..... 165/167
See application file for complete search history.

(56) References Cited

U.S. PATENT DOCUMENTS 2,623,736 A * 12/1952 Hytte ..... 165/167
4,176,713 A * 12/1979 Fisher ..... 165/167
4,523,638 A 6/1985 Rosman et al.
4,911,235 A * 3/1990 Andersson et al. ..... 165/167
5,392,849 A * 2/1995 Matsunaga et al. ..... 165/167
5,531,269 A * 7/1996 Dahlgren ..... 165/167
5,538,593 A * 7/1996 Sakai et al. ..... 165/167

(Continued)

FOREIGN PATENT DOCUMENTS

CN 2091441 U 12/1991

(Continued)

OTHER PUBLICATIONS

Chinese office action dated Feb. 10, 2006, and English translation.

(Continued)

*Primary Examiner*—Leonard R Leo
(74) *Attorney, Agent, or Firm*—Fish & Richardson P.C.

(57) ABSTRACT

A heat transfer plate for a plate heat exchanger has a first port portion (A), a second port portion (B), and a heat transfer portion, which is disposed between the port portions (A, B). The first port portion (A) has a first vapor inlet port (1) which is intended for a first fluid in vapor form and which extends over essentially the whole width of the plate. The second port portion (B) has at least one first outlet port (2), which is intended for condensed vapor. The first port portion (A) has a second outlet port (4), which is disposed between the vapor inlet port (1) and the second port portion (B) and which is intended for a second fluid. The second port portion (B) has a second inlet port (3), which is intended for the second fluid.

2 Claims, 2 Drawing Sheets

U.S. PATENT DOCUMENTS

| | | | | |
|---|---|---|---|---|
| 6,250,380 | B1 * | 6/2001 | Strahle et al. | 165/167 |

FOREIGN PATENT DOCUMENTS

| | | | | |
|---|---|---|---|---|
| DE | 197 16 200 | | 10/1998 | |
| EP | 0 411 123 | | 2/1991 | |
| FR | 2679021 | A1 * | 1/1993 | 165/167 |
| GB | 2 121 525 | | 12/1983 | |
| JP | 62-293086 | | 12/1987 | |
| SE | 514 682 | | 4/2001 | |

OTHER PUBLICATIONS

Baranovsky, N. V., "Plate and coil heat exchangers," 1973, pp. 20-27, 62-69.
"Heat exchangers reference book," 1987, Moscow, vol. 2, pp. 298-301.
English translation of Russian office action of Feb. 26, 2006.
Translation of JP office action mailed Oct. 9, 2007.

* cited by examiner

HEAT TRANSFER PLATE, PLATE PACK AND PLATE HEAT EXCHANGER

FIELD OF THE INVENTION

The present invention relates to a heat transfer plate for a plate heat exchanger, comprising a first port portion which is disposed in one edge portion of the heat transfer plate, a second port portion which is disposed in a second edge portion of the heat transfer plate, and a heat transfer portion which is disposed between said port portions. The invention also relates to a plate pack and a plate heat exchanger.

BACKGROUND ART

A plate heat exchanger comprises a plate pack consisting of a number of assembled heat transfer plates forming between them plate interspaces. Generally, every second plate interspace communicates with a first inlet channel and a first outlet channel, each plate interspace being adapted to define a flow area and to conduct a flow of a first fluid between said inlet and outlet channels. Correspondingly, the other plate interspaces communicate with a second inlet channel and a second outlet channel for a flow of a second fluid. Thus, the plates are in contact with one fluid through one of their side surfaces and with the other fluid through the other side surface, which allows a considerable heat exchange between the two fluids.

Modern plate heat exchangers have heat transfer plates, which in most cases are made of sheet-metal blanks that have been pressed and punched to obtain their final shape. Each heat transfer plate is usually provided with four or more "ports" consisting of through holes punched in the four corners of the plate. Sometimes, additional ports are punched along the short sides of the plates so as to be located between the ports punched in the corners. The ports of the different plates define said inlet and outlet channels, which extend through the plate heat exchanger transversely of the plane of the plates. Gaskets or any other form of sealing means are arranged round some of the ports alternatingly in every second plate interspace and, in the other plate inter-spaces, round the other ports so as to form the two separate channels for the first fluid and the second fluid, respectively.

Since considerable fluid pressure levels are obtained in the heat exchanger during operation, the plates need to be sufficiently rigid so as not to be deformed by the fluid pressure. The use of plates made of sheet-metal blanks is possible only if the plates are somehow supported. Generally, this is achieved by the heat transfer plates being provided with some kind of corrugation so that the plates bear against each other in a large number of points.

The plates are clamped together between two flexurally rigid end plates (or frame plates) in a "frame" and thus form rigid units with flow channels in each plate interspace. The end plates are clamped together by means of a number of clamp bolts, which engage both plates by the intermediary of recesses or holes made along the circumference of each end plate.

In recent years, plate heat exchangers have come into use in applications in which at least one of the fluids is subjected to a phase change (condensation or evaporation). In many processes, vapour is used for heating purposes for two reasons: on the one hand vapour contains a lot of energy that is released upon condensation and, on the other hand, the heating temperature is essentially constant. In the case of condensation temperatures exceeding 100° C. the temperature cannot be regulated by means of, for instance, a so-called vapour trap, which regulates the pressure of the condensate discharged. In the case of temperatures below 100° C. vapour traps do not work for natural reasons—no pressure can be achieved below atmospheric pressure. Instead, a condenser in which residual vapour is condensed must be used.

Conventional plate heat exchangers are not very well adapted for this task because of their symmetric design; ports of the same size and the same channel characteristic in both channels. In a typical application, the relationship between the vapour flow and the flow of cooling water is such that the diameter of the vapour inlet should be twice as large as that of the cooling water ports. Moreover, the channels in the plate inter-spaces should be highly asymmetric. The vapour requires a channel with a large cross-sectional area and low frictional resistance in order for the pressure drop to be minimized, and the cooling water requires a narrow channel with large frictional resistance that causes heavy turbulence.

In applications of this kind, the plates should have relatively large vapour ports to prevent the vapour phase pressure drop at the port or ports from becoming too great, which would have a detrimental effect on the efficiency of the heat exchanger. To allow for the provision of ports in a plate heat exchanger of the type mentioned above the plates have to be wide. This implies poor utilisation of the sheet-metal, which in turn makes the plate heat exchanger too expensive.

In this context, also the type of plate heat exchanger as described in DE-A1-19716200 should be mentioned. This publication discloses a plate heat exchanger in which all ports, i.e. also the ports for the different fluids, are positioned along one and the same line. The object stated in the DE publication is that it is desirable to obtain an improved distribution of the flow over the width of the heat transfer plates. The shape of the plate is essentially long and narrow and rectangular, and the two ports' for one of the fluids are positioned at the outer end of each short side of the plate whereas the two ports for the other fluid are positioned inside the same.

Furthermore, GB 2121525 discloses an evaporator or condenser made up of plates having respectively a long and narrow upper port and a long and narrow lower port intended for a first fluid, which is to be conducted to every second plate interspace. The two ports extend over the whole width of the plate. The plate further comprises a number of protrusions which are disposed outside the width of the plate and which each consist of a thin sheet-metal ring enclosing the corresponding port. These ports are intended to conduct a second fluid to the other plate interspaces. However, in this construction the frame plates must be of considerable size, since they need to extend over the whole width of the plate as well as the protrusions.

Nor does the design disclosed in U.S. Pat. No. 4,523,638 satisfy the design requirements stated above regarding efficient utilisation of the sheet-metal. Moreover, in this US publication the ports are disposed in conventional manner, i.e. one port in each corner. The preamble to claim 1 is based on such a conventional condenser.

Finally, EP 411,123 discloses a special type of falling-film condenser in which the inlet port and the outlet ports for the liquid are disposed adjacent to the lower edge. This particular type of condenser is intended for processes involving heat sensitive products, such as fruit juice, unrefined sugar solutions or the like, and does not provide any solution to the problems related above.

SUMMARY OF THE INVENTION

An object of the invention is to provide a solution to the problems stated above. A particular object of the invention is to provide a design which allows improved utilisation of the material of the heat transfer plates. Furthermore, the design must be such that satisfactory distribution of the fluid flow over the width of the plate is obtained. Further objects and advantages of the invention will be apparent from the following description.

The objects of the invention are achieved by means of a heat transfer plate, which is of the type stated above and which is characterised in that the first port portion comprises a first vapour inlet port which is intended for a first fluid in vapour form and which extends over essentially the whole width of the plate, that the second port portion comprises at least one first outlet port which is intended for condensed vapour, that the first port portion comprises a second outlet port which is disposed between said vapour inlet port and the second port portion and which is intended for a second fluid, and that the second port portion comprises a second inlet port which is intended for said second fluid. This port configuration is intended for use in applications in which the fluid undergoing a phase change changes from vapour to condensate, i.e. the heat exchanger acts as a condenser.

The invention may also be used for the opposite phase change, i.e. from liquid to vapour. In this case, the heat exchanger will act as an evaporator. The plate will have essentially the same design in both cases. The objects stated above are achieved by means of the plate intended for a phase change from liquid to vapour, which plate is of the type mentioned above and which is characterised in that the first port portion comprises a first vapour outlet port which is intended for a first fluid in vapour form and which extends over essentially the whole width of the plate, that the second port portion comprises at least one first inlet port which is intended for said first fluid in liquid form, that the first port portion comprises a second inlet port which is disposed between said vapour outlet port and the second port portion and which is intended for a second fluid, and that the second port portion comprises a second outlet port which is intended for said second fluid.

By designing the heat transfer plate in this manner, an extremely advantageous utilisation of the sheet-metal is obtained as well as a very high degree of efficiency of the condenser or evaporator. The large vapour port extending over essentially the whole width of the plate provides a vapour flow in which essentially no drop in pressure occurs. By arranging the port for the second fluid in the first port portion between the vapour port and the second port portion, benefit may be derived from the fact that, in connection with the phase change, only a relatively short distance is required in the direction of flow where the heat exchange takes place. By arranging the ports in two opposite port portions, the intermediate plate area is optimally utilised to achieve the desired heat exchange.

Preferred embodiments of the invention are apparent from the dependent claims.

According to a preferred embodiment, said second inlet port and said second outlet port have essentially the same port area. Since no phase change takes place in the fluid, which passes through these ports, the rate of flow is the same through the two ports. This embodiment affords the lowest pressure drop and, thus, is the most efficient.

Advantageously, said second inlet port has a port area of about 10-50%, preferably 15-40% and most preferred 20-30%, of the corresponding port area of said vapour inlet or vapour outlet port. This affords a particularly good relationship between the vapour supplied or discharged in the form of vapour and the fluid supplied or discharged in the form of liquid, which results in a high degree of efficiency of the plate heat exchanger. Moreover, owing to the large vapour port the vapour flow will not be subjected to any appreciable pressure drop.

According to a preferred embodiment, said at least one first outlet port intended for condensed vapour or first inlet port intended for the first fluid in liquid form comprises two ports, which are disposed in two corners of the heat transfer plate. In this manner, use can be made of the small corners of the plate, which would otherwise not have been used. During the phase change into liquid, the vapour releases a large amount of heat per weight unit to the second fluid, which means that it is possible to use a rate of flow which when measured in the condensed state is relatively small. This allows the use of relatively small ports, which may be arranged in such manner that the best possible use is made of the metal-sheet surface.

In a preferred embodiment, the port disposed in the second port portion and intended for the second fluid is arranged between said at least one port intended for the first fluid and the first port portion. This means that satisfactory flow distribution of the condensed vapour or of the liquid to be evaporated is obtained over the whole width of the plate, since the port intended for the second fluid will by itself force the flow stream to be distributed as it flows adjacent to the port.

According to another preferred embodiment, the ports in the second port portion, which are intended for said first fluid and said second fluid, are disposed next to each other at essentially the same distance from the first port portion. This design implies an advantageous use of the plate surface.

According to yet another preferred embodiment, the port disposed in the first port portion and intended for the second fluid is offset relative to the vapour inlet or vapour outlet port in such manner that it is located along an edge of the plate. It is thus possible to ensure that a minimum pressure drop is obtained for the vapour port formed in the first port portion, which in turn makes it possible to obtain a higher degree of efficiency in the plate heat exchanger.

According to a preferred embodiment, the plate is symmetric about its longitudinal axis. This is preferred from the point of view of manufacture since it allows one single plate type to be used alternatingly by rotating every second plate a half turn about its symmetry axis.

The above objects are also achieved by means of a plate pack comprising a plurality of heat transfer plates of the types mentioned above.

In the plate pack, said first inlet port of the heat transfer plates forms a first inlet channel through the plate pack, said first outlet port forms a first outlet channel through the plate pack, said second inlet port of the heat transfer plates forms a second inlet channel through the plate pack and said second outlet port of the heat transfer plates forms a second outlet channel through the plate pack, the first inlet channel and the first outlet channel being in fluid communication with each other via a first set of plate interspaces and the second inlet channel and the second outlet channel communicating with each other via a second set of plate interspaces.

Advantageously, each of the plate interspaces in the first set has a channel height or volume that is greater than each of the plate interspaces in the second set. This allows a high degree of efficiency to be obtained. The vapour pressure drop will be small and a large amount of vapour can be supplied, which is desirable since the vapour has a considerably larger volume than a liquid. Moreover, the second fluid will be subjected to a greater pressure drop, the second fluid flow will be more turbulent and the heat transfer more efficient.

The objects stated above are also achieved by means of a plate heat exchanger comprising a number of heat transfer plates of the type stated above and by means of a plate heat exchanger comprising a number of plate packs of the type stated above.

BRIEF DESCRIPTION OF THE DRAWINGS

The invention will be described in more detail below with reference to the accompanying schematic drawings, which by way of example illustrate currently preferred embodiments of the invention.

DETAILED DESCRIPTION OF PREFERRED EMBODIMENTS

Figure 1:
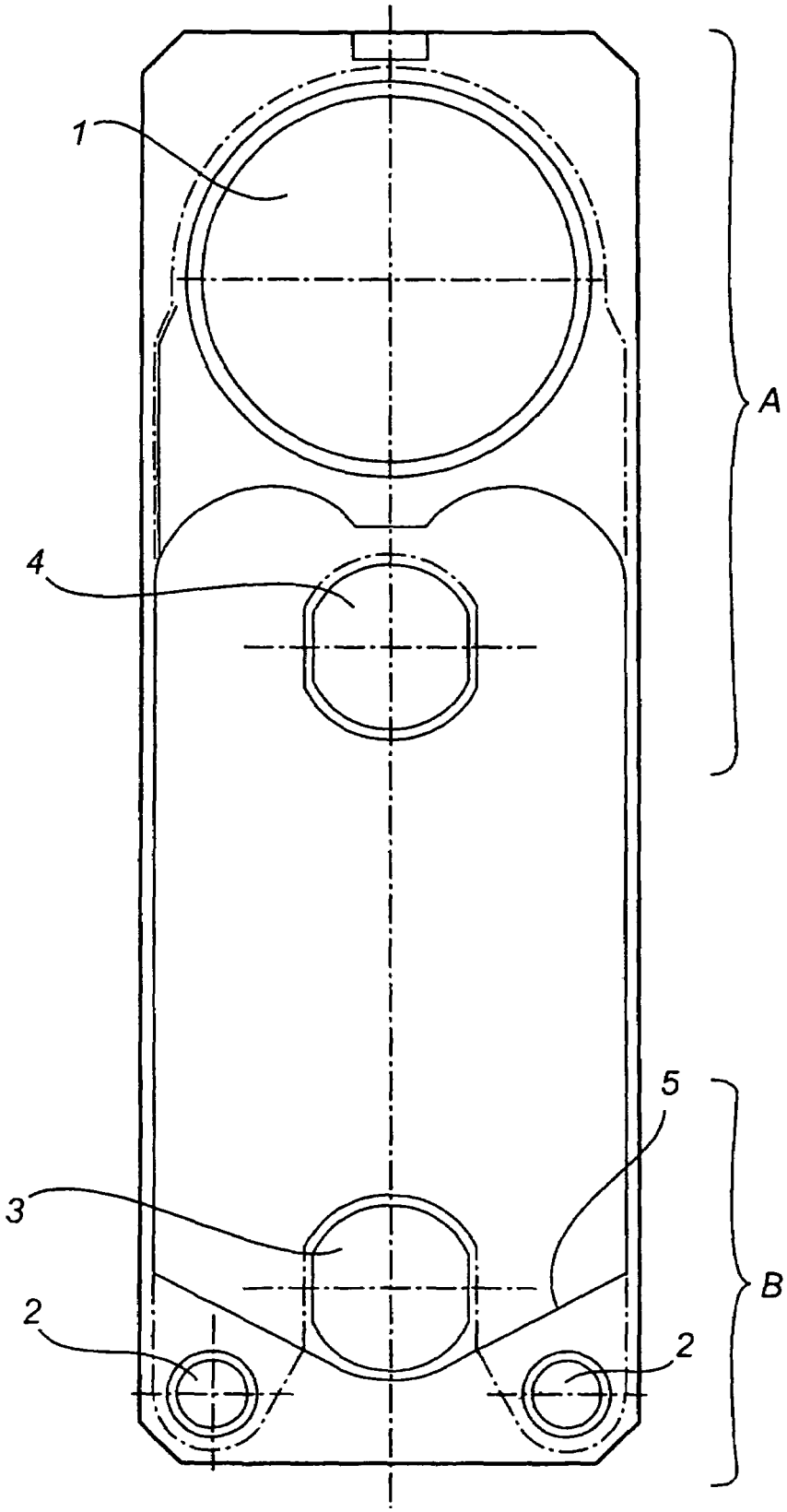
FIG. 1 shows a heat transfer plate according to a first embodiment of the invention.
Figure 2:
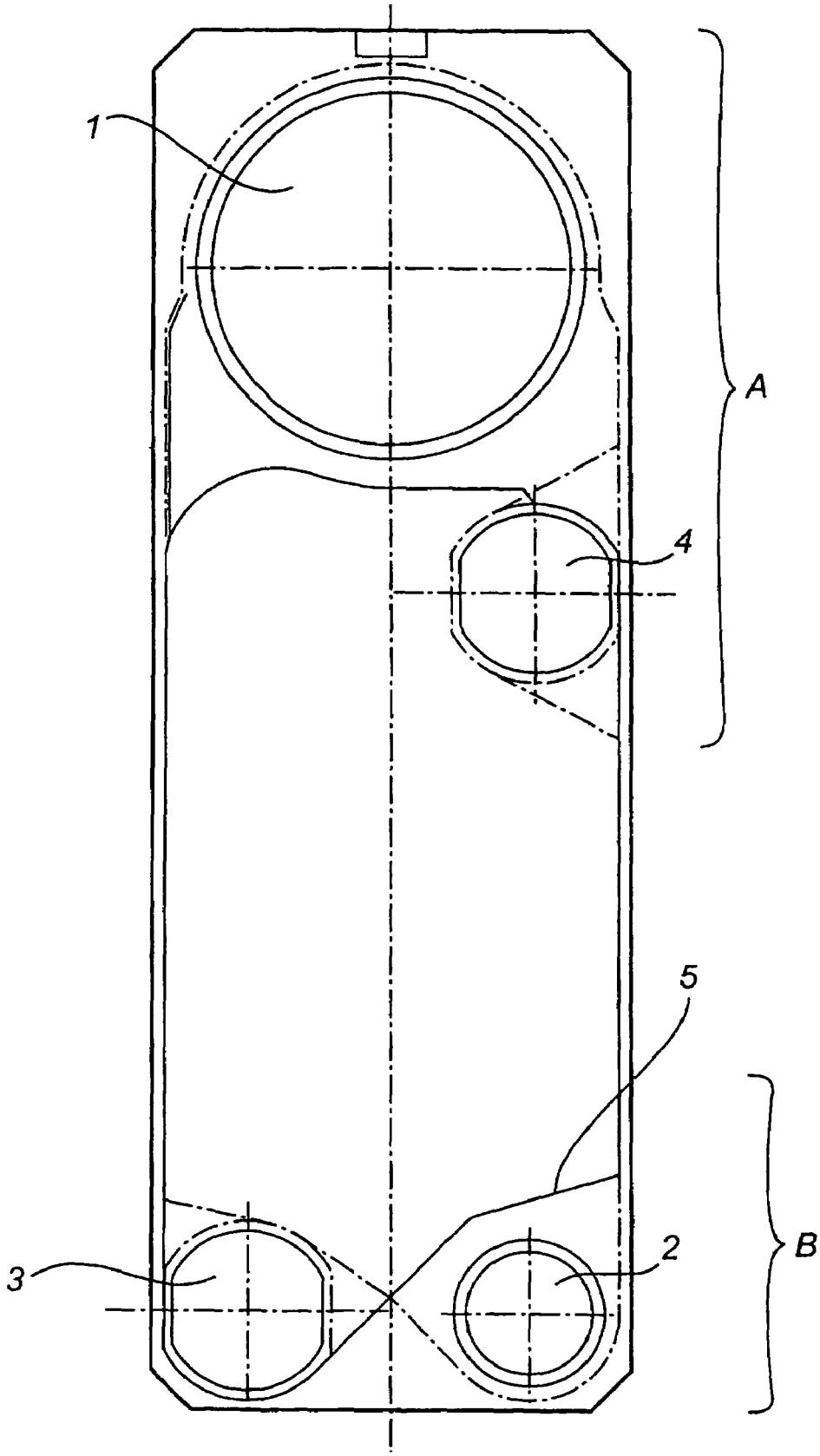
FIG. 2 shows a heat transfer plate according to a second embodiment of the invention.

As shown in FIGS. 1 and 2, the heat transfer plate according to the preferred embodiments has a long and narrow, essentially rectangular shape. A port portion A, B is provided on both short sides. In the respective port portions through holes, called ports 1-4, are provided. These heat transfer plates are adapted to be assembled into a plate pack in conventional manner, so that each of the ports forms a channel extending through the plate pack of the plate heat exchanger (not shown).

For the sake of simplicity, the heat transfer plates described below will be adapted for use in applications in which the fluid undergoing a phase change changes from vapour to condensate. In other words, the heat transfer plates described will be adapted for use in a condenser. For the opposite phase change, i.e. from liquid to vapour (evaporator), the heat transfer plates will have essentially the same design.

The first port 1 forms a first inlet channel, which is intended for a first fluid, whereas the second port 2 forms a first outlet channel, which is intended for said fluid. The third port 3 forms a second inlet channel, which is intended for a second fluid and the fourth port 4 forms a second outlet channel, which is intended for said fluid. Generally, every second plate interspace communicates with the first inlet channel and the first outlet channel, each plate interspace being adapted to define a flow area and to conduct a flow of the first fluid between said inlet and outlet channels. Correspondingly, the other plate interspaces communicate with the second inlet and outlet channel for a flow of the second fluid. Thus, the plates are in contact with one fluid through one of their side surfaces and with the other fluid through the other side surface, which allows a considerable heat exchange between the two fluids.

In FIGS. 1 and 2, sealing gaskets-S which extend round the second inlet port 3 and the second outlet port 4 are indicated by unbroken lines. A similar gasket is provided on every second heat transfer plate of the plate pack. On the intermediate heat transfer plates, a gasket is provided which extends round the first inlet port 1 and the first outlet port 2. These gaskets contribute to the formation of separate channels through the plate heat exchanger, one for the first heat exchanging fluid and one for the second heat exchanging fluid.

The above description, in which specific embodiments have not been taken into particular consideration, is applicable to the embodiments described below unless otherwise stated in connection with the description of the respective embodiments.

In the embodiment shown in FIG. 1, the heat transfer plate comprises a first vapour inlet port 1 in the upper port portion A. The vapour inlet port 1 is intended for a first fluid in vapour form and extends over essentially the whole width of the heat transfer plate. Furthermore, the port portion A comprises a second outlet port 4, which is disposed along the same geometric centre line as the vapour inlet port 1 and arranged between the first vapour inlet port 1 and the lower port portion B.

The lower port portion B comprises a second inlet port 3, which is disposed along said geometric centre line. As shown in FIG. 1, said second inlet port 3 and said second outlet port 4 have essentially the same port area. The ports 3, 4 have a port area of about 10-50%, preferably 15-40% and most preferred 20-30%, of the corresponding port area of the vapour inlet port 1.

The lower port portion B further comprises two first outlet ports 2, which are disposed in the two corners of the heat transfer plate. The outlet ports 2 form outlet channels for a condensate through the plate pack.

FIG. 2 illustrates a second embodiment of the heat transfer plate shown in FIG. 1. As shown in FIG. 1, the heat transfer plate comprises a vapour inlet port 1, which is disposed in the upper port portion A. The port portion A further comprises a second outlet port 4, which in this second embodiment is offset relative to said vapour inlet port 1. The second outlet port 4 is disposed along one side portion of the heat transfer plate.

The lower port portion B comprises a first outlet port 2 and a second inlet port 3. Said outlet and inlet ports 2, 3 are disposed next to each other in the two corners of the heat transfer plate.

The second inlet port 3 and the second outlet port 4 have essentially the same port area also in this second embodiment. The size of said ports corresponds to the size described in the first embodiment.

It will be appreciated that various modifications of the embodiments of the invention described above are possible within the scope of the invention, as defined by the appended claims. For example, the position of the ports on the heat transfer plate and their relative sizes may be slightly adjusted in different applications.

What is claimed is:

1. A system for exchanging heat between two fluids, one of which is a vapor to be cooled to form a condensed vapor and the other of which is a liquid that is warmed by heat from the vapor, comprising sources for the vapor and the liquid that exchange heat in a plate heat exchanger, collectors for the condensed vapor and the warmed liquid that leave the plate heat exchanger, and the plate heat exchanger comprising a number of heat transfer plates, each having an essentially rectangular outer periphery, and being symmetric about its longitudinal axis, and having, within said outer periphery, a first port portion which is disposed in one edge portion of the heat transfer plate, a second port portion which is disposed in a second edge portion of the heat transfer plate, and a heat transfer portion which is disposed between said port portions and extends between side outer peripheral edges of the heat transfer plate and which has a heat transfer surface across substantially its entire width and length wherein the first port portion comprises a circular vapor inlet port and extends over essentially the whole width of the plate, the second port portion comprises at least one first outlet port which is relatively smaller than the first vapor inlet port and is for condensed vapor, the first port portion further comprises a second outlet port which is disposed between said vapor inlet port and the second port portion for the warmed liquid, the second port portion further comprises a second inlet port for the liquid to be warmed, which is arranged between said at least one first outlet port for condensed vapor and the first port portion, and the second inlet port has a port area that is 10-50% of the corresponding port area of said vapor inlet port.

2. A method of using a plate heat exchanger comprising a number of heat transfer plates, each having an essentially rectangular outer periphery, and being symmetric about its longitudinal axis, and having, within said outer periphery, a first port portion which is disposed in one edge portion of the heat transfer plate, a second port portion which is disposed in a second edge portion of the heat transfer plate, and a heat transfer portion which is disposed between said port portions and extends between side outer peripheral edges of the heat transfer plate and which has a heat transfer surface across its entire width and length wherein the first port portion comprises a circular first vapor inlet port which extends over essentially the whole width of the plate, the second port portion comprises at least one first condensed vapor outlet port which is relatively smaller than the first vapor inlet port, the first port portion comprises a second outlet port for a second fluid which second outlet port is disposed between said first vapor inlet port and the second port portion, the second port portion comprises a second inlet port for said second fluid, which second inlet port is arranged between said at least one first condensed vapor outlet port and the first port portion, and the second inlet port has a port area that is 10-50% of the corresponding port area of said first vapor inlet port wherein said first vapor inlet ports of the heat transfer plates form a first inlet channel through the heat transfer plates of the heat exchanger, said first condensed vapor outlet ports of the heat transfer plates form a first outlet channel through the heat transfer plates, said second inlet ports of the heat transfer plates form a second inlet channel through the heat transfer plates and said second outlet ports of the heat transfer plates form a second outlet channel through the heat transfer plates, the first inlet channel and the first outlet channel being in fluid communication with each other via a first set of plate interspaces and the second inlet channel and the second outlet channel communicating with each other via a second set of plate interspaces, and each of the plate interspaces in the first set having a channel height that is greater than each of the plate interspaces in the second set, said first and said second sets of plate interspaces being in heat transfer communication with one another, the method comprising cooling a vapor to form a condensed vapor by passing said vapor into said first inlet channel and through said first set of plate interspaces and removing said condensed vapor from the heat exchanger by passing it through said first outlet channel, and simultaneously warming the second fluid by passing the second fluid into said second inlet channel and though said second set of plate interspaces and removing said warmed second fluid from the heat exchanger by passing it through said second outlet channel.

* * * * *

UNITED STATES PATENT AND TRADEMARK OFFICE

CERTIFICATE OF CORRECTION

PATENT NO. : 7,607,472 B2
APPLICATION NO. : 10/481197
DATED : October 27, 2009
INVENTOR(S) : Ralf Blomgren It is certified that error appears in the above-identified patent and that said Letters Patent is hereby corrected as shown below:

Column 8, line 32, in Claim 2, delete "though", insert --through--.

Signed and Sealed this

Twenty-third Day of February, 2010

David J. Kappos

David J. Kappos
*Director of the United States Patent and Trademark Office*